United States Patent [19]

Sajdak, Jr.

[11] Patent Number: 4,869,695

[45] Date of Patent: Sep. 26, 1989

[54] STORAGE BOOT AND METHOD FOR FLUSHING OUTBOARD MOTORS

[76] Inventor: Edward Sajdak, Jr., P.O. Box 1601, Largo, Fla. 34649-1601

[21] Appl. No.: 295,256

[22] Filed: Jan. 9, 1989

[51] Int. Cl.[4] ..... B08B 3/02; B63B 59/00

[52] U.S. Cl. ..... 440/88; 114/222; 440/900; 440/113; 134/167 R

[58] Field of Search ..... 440/88, 113, 900; 114/219, 222; 134/166 R, 167

[56] References Cited

U.S. PATENT DOCUMENTS

| | | | |
|---|---|---|---|
| 632,919 | 9/1899 | Farley | 114/222 |
| 2,644,474 | 7/1953 | Houchin | 134/166 |
| 3,886,889 | 6/1975 | Burger | 440/113 |
| 4,282,822 | 8/1981 | Jackson | 114/222 |
| 4,729,393 | 8/1988 | Ferguson | 440/88 |

*Primary Examiner*—Joseph F. Peters, Jr.
*Assistant Examiner*—Edwin L. Swinehart
*Attorney, Agent, or Firm*—Herbert W. Larson

[57] ABSTRACT

A flexible cylindrical boot with a plastic reinforced opening containing multiple nylon rivets for connection to one or more nylon cords is mounted around the shaft of a small outboard motor. A telescopic handle attached to the reinforced opening guides the boot around the motor shaft after a garden hose is attached to a connector integral with a bottom of the boot. Fresh water from a faucet fills the boot and the motor is run in an idle condition to permit salt water flushing of the coolant system. The brackish water is then siphoned from the boot for dry storage of the motor in an upright position attached to the transom or lazarette of a boat.

10 Claims, 2 Drawing Sheets

STORAGE BOOT AND METHOD FOR FLUSHING OUTBOARD MOTORS

BACKGROUND OF THE INVENTION

1. Field of the Invention

This invention relates to a device and method for water flushing and storing an outboard motor. More particularly, it refers to a fresh water flushing and storage boot for enclosing a boat mounted outboard motor in a vertical position in the water.

2. Description of the Prior Art

Outboard motors are commonly used in salt or brackish water and require flushing with fresh water after use in order to slow salt water corrosion of internal water coolant parts. The two most common methods of flushing such motors currently employed are removal of the motor and running it in a barrel filled with fresh water or attaching a connection to the coolant system and injecting fresh water under pressure from an external source as shown in U.S. Pat. No. 2,644,474.

In the first method, there is incomplete flushing since the expelled salt water is mixed with the fresh water and reintroduced into the coolant system in a diluted form. In the latter method, the connection to the coolant system in modern outboard engines is below the water line. Therefore, the engine must be raised to make the fresh water connection. It is inconvenient to reach the connection when the motor is connected to the boat transom and in some boats, such as sailboats, this inconvenience is greatly magnified. A more simple and easily employable flushing system is needed, particularly for outboard motors used as auxiliary power sources on sailboats.

SUMMARY OF THE INVENTION

I have invented a flexible cylindrical boot with a reinforced opening containing multiple nylon rivets for attaching a nylon strap over a top of the outboard motor. A handle member attaches to the reinforced opening and a hose connector is integral with a bottom surface of the boot. A hose, connected at a first end to the connector and at a second end to a siphon/faucet permits fresh water to be pumped into the boot to water level while the motor is in a vertical position. The coolant system can then be flushed by running the motor. Afterward, the flushed out water is siphoned from the boot and the motor is stored in a dry condition while still mounted on the boat transom in a vertical position. As an alternative the boot can be refilled with fresh water and stored in such water. The handle is used to remove the boot when it is desired to operate the vessel or to place the boot over the motor.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
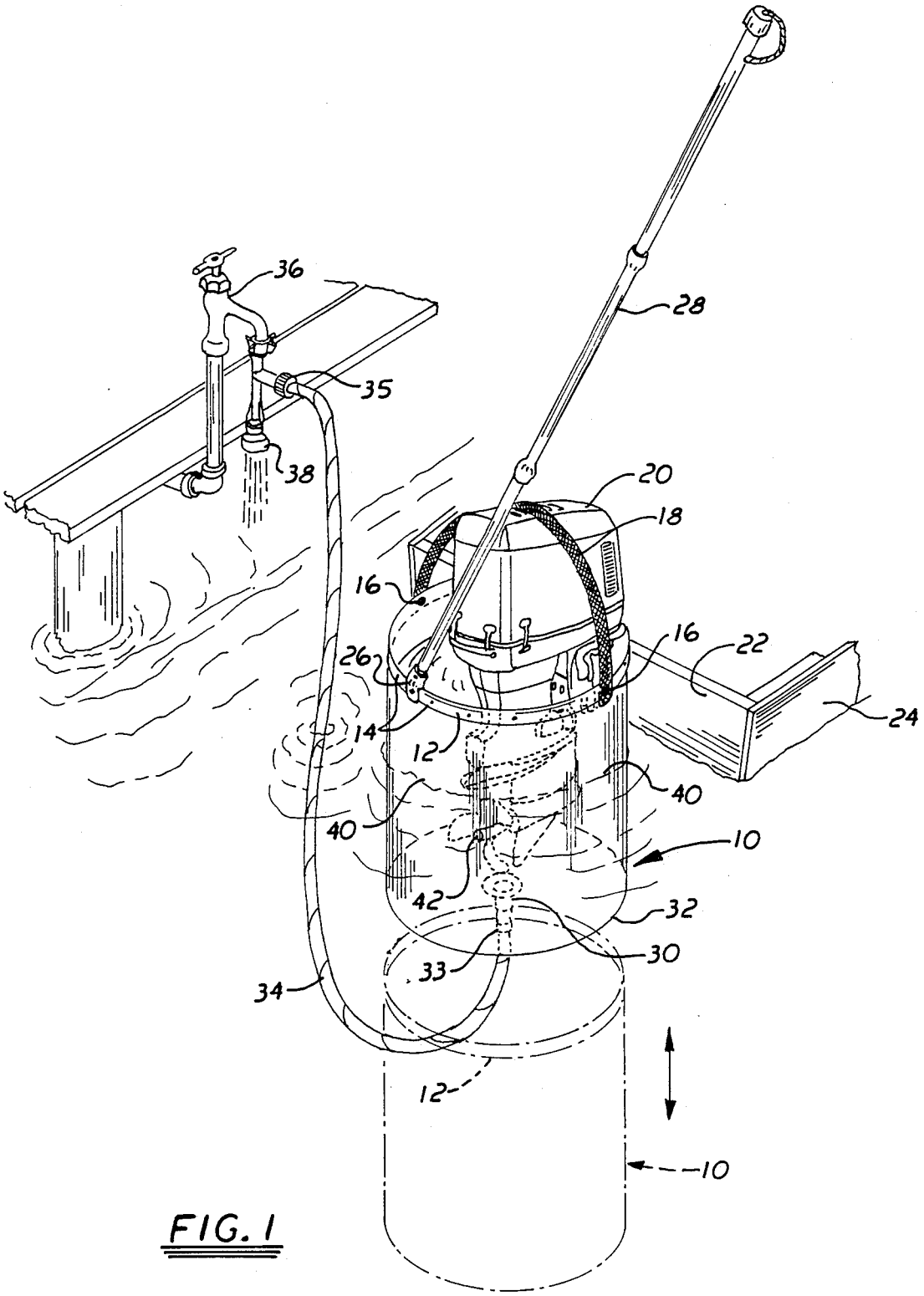
FIG. 1 is a perspective view of the storage boot mounted on an outboard motor.

Throughout the following detailed description, the same reference numerals refer to the same elements in all figures.

The storage boot 10 as shown in FIG. 1, is cylindrical in shape having a stiff rim 12 made from a plastic substance, such as high density polyethylene or polypropylene. The rim 12 has a series of rivets 14 to hold the top of the boot to the rim 12 and rivets 16 are used to secure a nylon cord 18 over the top of the outboard motor 20. The motor is in a vertical position attached to a transom 22 of boat 24. Bracket 26 attaches an extendable handle 28 to rim 12.

The boot can be a twenty millimeter polyethylene or polypropylene flexible plastic with a diameter of about one one-half meters. The length of the boot will slightly exceed the bottom of the motor by a few centimeters and be approximately the same length as the motor shaft 42. The extendable handle 28 is used to guide the boot 10 towards the motorshaft 42.

Connector 30 integral with the bottom surface 32 of boot 10 is connected to a first end 33 of hose 34. The hose 34 is attached at a second end 35 to a faucet 36 which has a siphon 38 adaptor.

After the garden hose 34 is connected to the adaptor 30, the handle 28 is used to guide the boot over the shaft 42 of the motor 20. The faucet is then opened to allow fresh water to fill the boot. The nylon cord 18 is attached over the top of motor 20. The boot is filled to overflow with fresh water. The outside water level 40 supports the boot.

Motor 20 is then placed in neutral and is run at a low revolution per minute to permit full exchange of the fresh water within the boot throughout the coolant system of the motor 20. After about five to ten minutes, with flushing completed, the siphon 38 is set to drain so that all water is evacuated from the boot leaving the outboard motor dry, but still attached to the transom of the boat in a vertical position. If one chooses to maintain the motor in fresh water, additional water is allowed to flow from faucet 36 through connector 30 into the boot to the water level 40. The shaft length of the outboard motor 20 is not important. However, the length of the boot must at least exceed the bottom of shaft 42 by a few centimeters.

Figure 2:
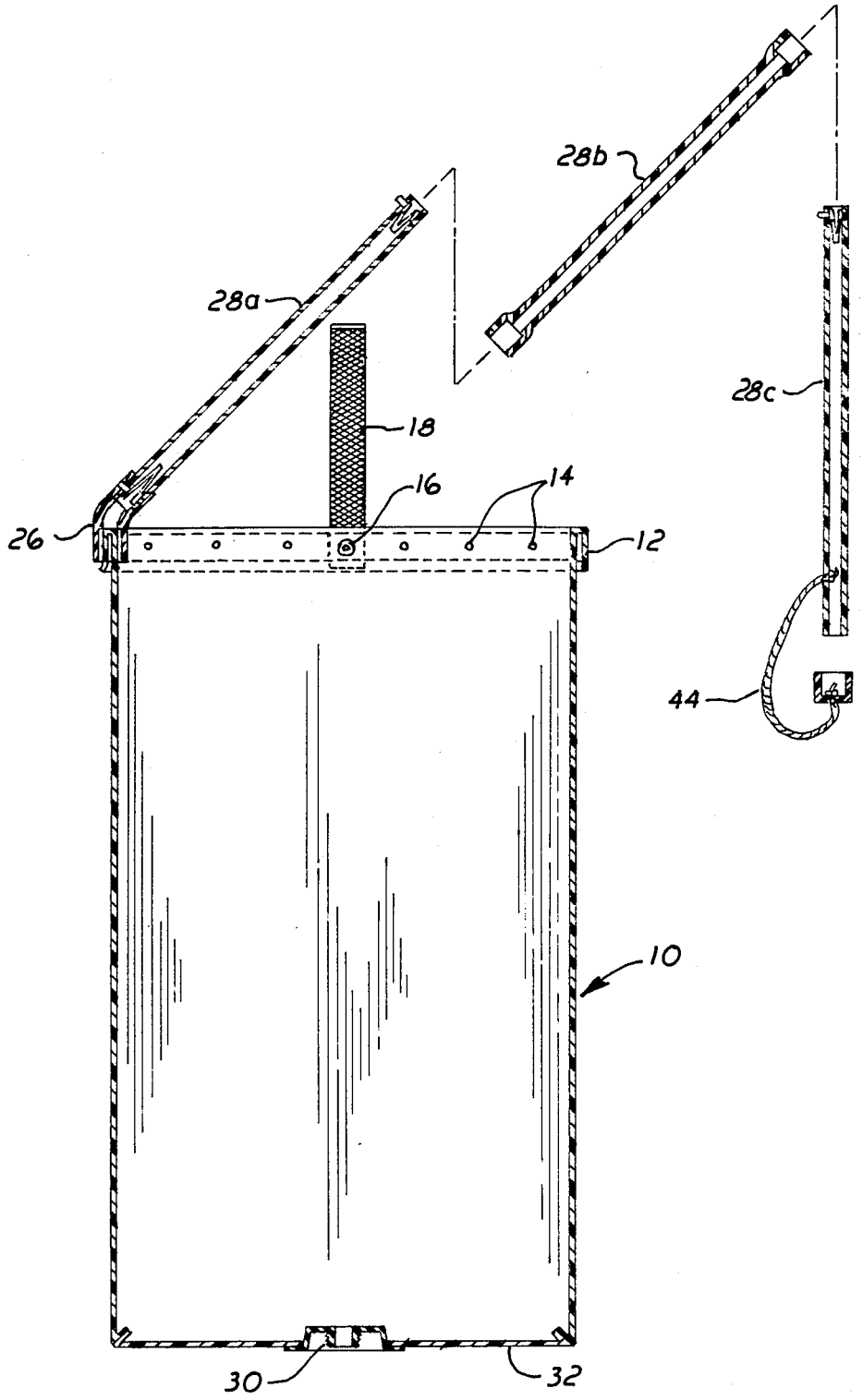
FIG. 2 is a section view in elevation through the boot.

The handle 28 can be telescopic as shown in FIG. 2 wherein, section **28*a* attaches at connector 26 to the rim 12 and section 28*b* is intermediate with section 28*c* being distal from the connection 26. A rope handle 42 is added to handle 28** to prevent slippage.

The adaptor 30 corresponds in its threaded exterior to the standard size of a hose for ease of connection to the standard garden hose 34.

The boot 10 can be used for any transom mounted or lazarette mounted outboard motor up to approximately 15 hp as commonly used on smaller sailboats. This device facilitates the flushing of these smaller outboard motors without the need for removing the motor from the water or from the transom or lazarette of the boat.

Equivalent elements can be substituted for the various boot elements and handle of the present invention without departing from its scope.

Having thus described the invention, what is claimed and desired to be secured by Letters Patent is:

1. A storage device for small outboard motors mounted in a vertical position on the transom or lazarett of a water moored vessel, the device comprising:

a flexible cylindrical boot having a diameter sufficient to circumscribe a small outboard motor shaft;

the boot open at a top end and a top edge of the boot affixed to a stiff annular plastic rim;

the boot closed at a bottom end with a hose connector fixture integral with a bottom surface of the boot;

the plastic rim having multiple holding means arranged thereabout and a means for securing the boot to the motor attached to the holding means; and a guide handle attached to the plastic rim.

2. A storage device according to claim 1 wherein the plastic rim is about one and one-half meters in diameter.

3. A storage device according to claim 1 wherein the plastic rim is high density polyethylene.

4. A storage device according to claim 1 wherein the plastic rim is polypropylene.

5. A storage device according to claim 1 wherein the means for securing the boot to the motor is a nylon cord of sufficient length to overlap a top of the motor.

6. A storage device according to claim 1 wherein the guide handle is telescopic.

7. A method of flushing the coolant system of a small outboard motor mounted in a vertical position on the transom or lazarette of a water moored vessel comprising:

(a) providing a cylindrical boot having a diameter sufficient to circumscribe a small outboard motor shaft, (b) attaching a handle to a stiff rim around a first open end of the boot, (c) attaching a hose to a connecting fixture in a second closed end of the boot, (d) partially filling the boot with fresh water, (e) guiding the boot around the shaft of the motor and attaching the boot to the motor, (f) filling the boot with fresh water, (g) running the outboard motor at idle speed to flush its coolant system, and (h) evacuating the water from the boot so that the motor shaft is not in contact with any salt water.

8. The method according to claim 7 wherein the stiff rim is polyethylene.

9. The method according to claim 7 wherein the stiff rim is polypropylene.

10. The method according to claim 7 wherein the boot is attached to the motor by a cord engaged to the stiff rim of the boot.

* * * * *